US007695365B2

(12) United States Patent
Casey

(10) Patent No.: US 7,695,365 B2
(45) Date of Patent: Apr. 13, 2010

(54) SLOT MACHINE WITH PERSISTENT CHANGE IN SYMBOL FUNCTION

(75) Inventor: Michael P. Casey, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 923 days.

(21) Appl. No.: 10/938,308

(22) Filed: Sep. 10, 2004

(65) Prior Publication Data

US 2006/0068881 A1 Mar. 30, 2006

(51) Int. Cl.
*A63F 9/00* (2006.01)

(52) U.S. Cl. ..... 463/20

(58) Field of Classification Search ..... 463/20, 463/12, 13, 22

See application file for complete search history.

(56) References Cited

U.S. PATENT DOCUMENTS

| | | | | |
|---|---|---|---|---|
| 5,833,537 | A * | 11/1998 | Barrie | 463/21 |
| 5,833,538 | A * | 11/1998 | Weiss | 463/21 |
| 6,089,977 | A | 7/2000 | Bennett | 463/20 |
| 6,190,254 | B1 | 2/2001 | Bennett | 463/13 |
| 6,251,013 | B1 | 6/2001 | Bennett | 463/13 |
| 6,270,411 | B1 | 8/2001 | Gura et al. | 463/20 |
| 6,290,600 | B1 | 9/2001 | Glasson | 463/20 |
| 6,311,976 | B1 * | 11/2001 | Yoseloff et al. | 273/138.2 |
| 6,517,432 | B1 | 2/2003 | Jaffe | 463/16 |
| 6,551,187 | B1 | 4/2003 | Jaffe | 463/20 |
| 6,805,349 | B2 * | 10/2004 | Baerlocher et al. | 273/138.2 |
| 6,811,486 | B1 * | 11/2004 | Luciano, Jr. | 463/24 |
| 2002/0025849 | A1 | 2/2002 | Olive | 463/29 |
| 2002/0039918 | A1 * | 4/2002 | Anderson et al. | 463/16 |
| 2002/0052233 | A1 * | 5/2002 | Gauselmann | 463/20 |
| 2002/0155881 | A1 * | 10/2002 | Yoshida | 463/20 |
| 2003/0054874 | A1 * | 3/2003 | Kaminkow | 463/20 |
| 2003/0057645 | A1 * | 3/2003 | Baerlocher et al. | 273/138.2 |
| 2003/0064793 | A1 * | 4/2003 | Baerlocher et al. | 463/25 |
| 2003/0216166 | A1 * | 11/2003 | Baerlocher et al. | 463/20 |
| 2003/0232644 | A1 * | 12/2003 | Takahashi et al. | 463/20 |
| 2004/0033827 | A1 | 2/2004 | Gilmore et al. | 463/20 |
| 2004/0038730 | A1 * | 2/2004 | Suda | 463/20 |
| 2004/0053676 | A1 * | 3/2004 | Rodgers | 463/20 |
| 2004/0097279 | A1 * | 5/2004 | Gauselmann | 463/16 |
| 2004/0137982 | A1 * | 7/2004 | Cuddy et al. | 463/20 |
| 2004/0219968 | A1 * | 11/2004 | Fiden et al. | 463/20 |

(Continued)

FOREIGN PATENT DOCUMENTS

EP 1150261 A2 10/2001

(Continued)

*Primary Examiner*—Peter DungBa Vo
*Assistant Examiner*—Seng H Lim
(74) *Attorney, Agent, or Firm*—Nixon Peabody LLP

(57) ABSTRACT

A slot machine conducts a wagering game in which a plurality of arrays of symbols are successively displayed. Each array may, for example, result from a free spin of a plurality of symbol-bearing reels during a bonus feature. In each free spin, the reels are rotated and stopped to place the symbols on the reels in visual association with a display area. In response to a random event, at least one symbol may change its function and maintain that function for a plurality of the successive free spins. For example, the symbol may become a wild symbol or a scatter pay symbol. Payouts for the free spins are awarded according to a pay table.

24 Claims, 6 Drawing Sheets

U.S. PATENT DOCUMENTS

| | | | | |
|---|---|---|---|---|
| 2004/0219969 | A1* | 11/2004 | Casey et al. | 463/20 |
| 2004/0266515 | A1* | 12/2004 | Gauselmann | 463/20 |
| 2006/0025205 | A1* | 2/2006 | Casey et al. | 463/20 |
| 2006/0264254 | A1* | 11/2006 | Aoki | 463/20 |

FOREIGN PATENT DOCUMENTS

| | | | |
|---|---|---|---|
| GB | 2097160 | A | 10/1982 |

* cited by examiner

SLOT MACHINE WITH PERSISTENT CHANGE IN SYMBOL FUNCTION

FIELD OF THE INVENTION

The present invention relates generally to gaming machines and, more particularly, to a slot machine including a persistent change in the functionality of a symbol.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome of the basic game. Because the bonus game concept offers tremendous advantages in player appeal and excitement relative to other known games, and because such games are attractive to both players and operators, there is a continuing need to develop new features and themes for bonus games to satisfy the demands of players and operators. Preferably, such new bonus game features and themes will maintain, or even further enhance, the level of player excitement offered by bonus games heretofore known in the art. The present invention is directed to satisfying these needs.

SUMMARY OF THE INVENTION

A slot machine conducts a wagering game in which a plurality of arrays of symbols are successively displayed. Each array may, for example, result from a free spin of a plurality of symbol-bearing reels. In each free spin, the reels are rotated and stopped to place the symbols on the reels in visual association with a display area. In response to a random event, at least one symbol may change its function and maintain that function for a plurality of the successive free spins. For example, the symbol may become a wild symbol or a scatter pay symbol. Payouts for the free spins are awarded according to a pay table. In one embodiment, the plurality of arrays are successively displayed during a bonus game triggered by a start-bonus outcome in a basic game.

BRIEF DESCRIPTION OF THE DRAWINGS

The foregoing and other advantages of the invention will become apparent upon reading the following detailed description and upon reference to the drawings in which.

Figure 1:
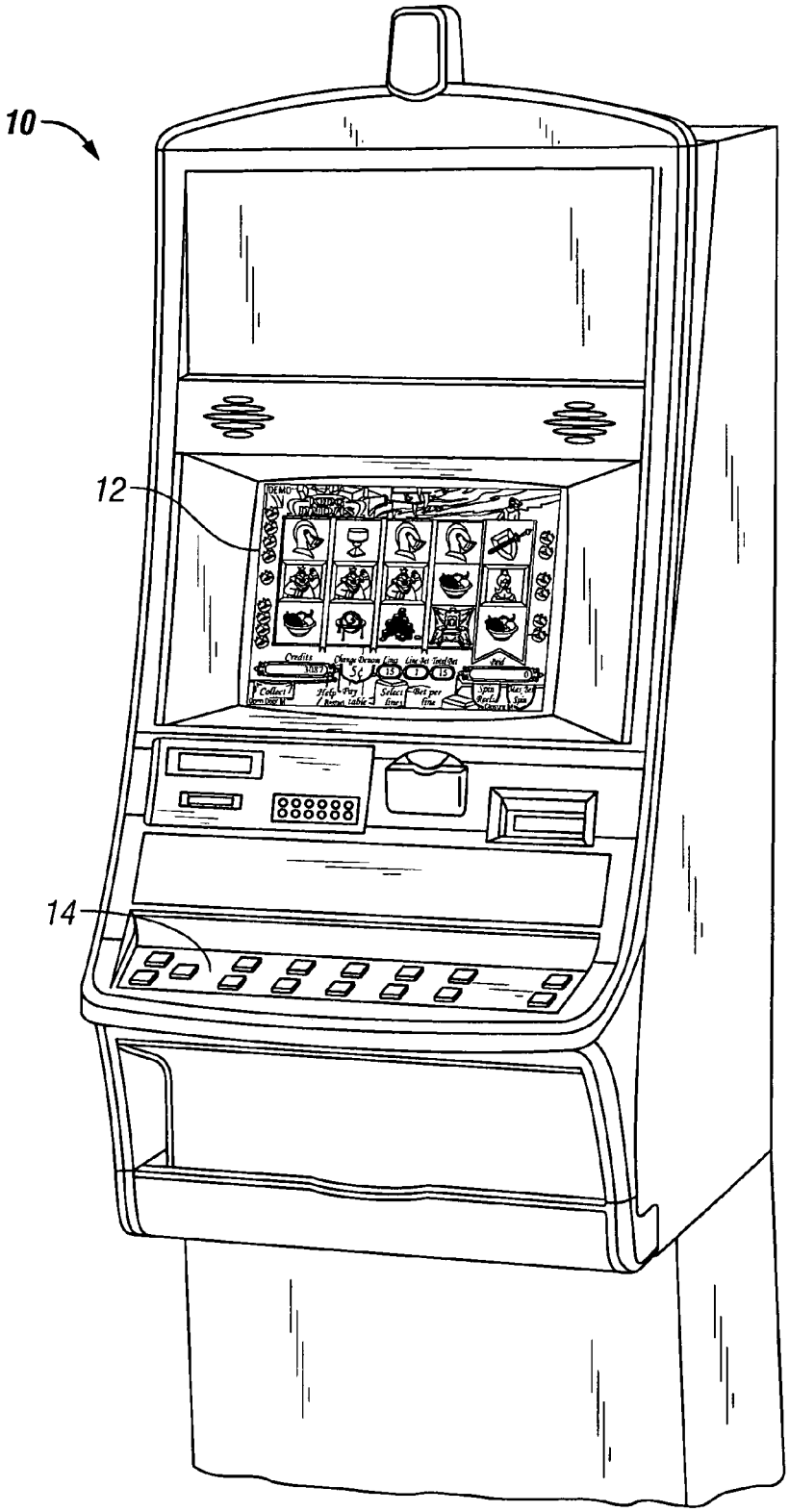
FIG. 1 is a perspective view of a gaming machine embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, a gaming machine 10 is operable to play a wagering game having a treasure theme. The wagering game includes a basic slot game with five simulated spinning reels and a free spin bonus feature triggered by a start-feature outcome in the basic slot game. In addition to the free spin feature, the basic slot game may produce certain outcomes for triggering other special features and bonus games.

The gaming machine 10 includes a visual display 12 preferably in the form of a CRT, LCD, plasma, LED, or other type of video display known in the art. The display 12 preferably includes a touch screen overlaying the monitor. In the illustrated embodiment, the gaming machine 10 is an "upright" version in which the display 12 is oriented vertically relative to the player. Alternatively, the gaming machine may be a "slant-top" version in which the display 12 is slanted at about a thirty-degree angle toward the player of the gaming machine 10.

Figure 2:
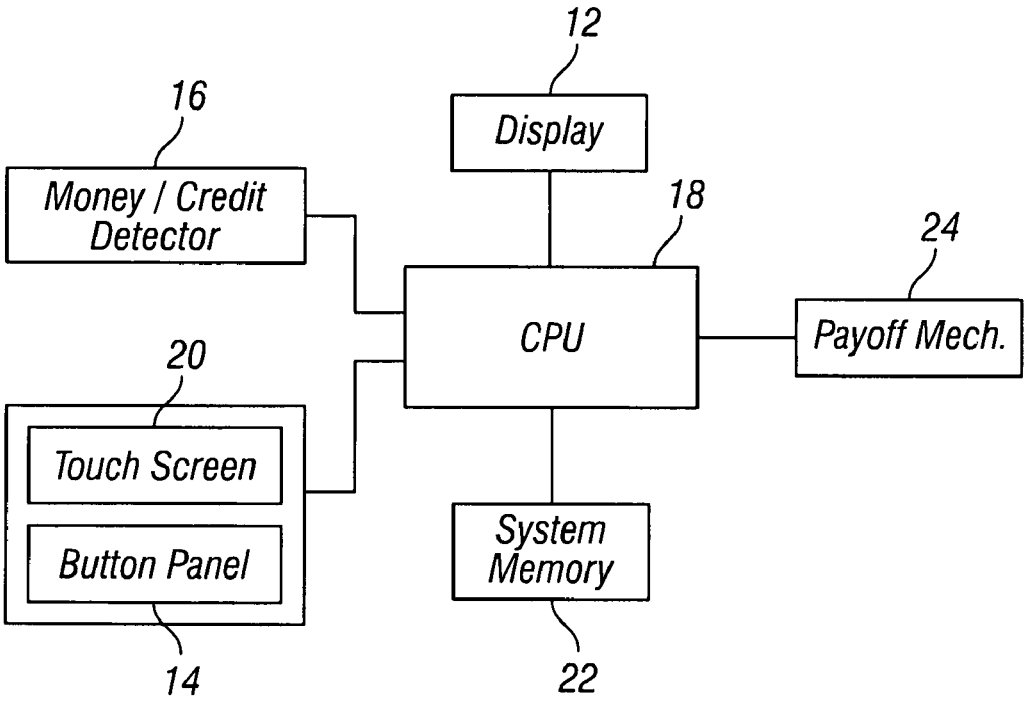
FIG. 2 is a block diagram of a control system suitable for operating the gaming machine.

FIG. 2 is a block diagram of a control system suitable for operating the gaming machine 10. Money/credit detector 16 signals a central processing unit ("CPU") 18 when a player has inserted money or played a number of credits. The money may be provided by coins, bills, tickets, coupons, cards, etc. Then, the CPU 18 operates to execute a game program that causes the display 12 to display five simulated symbol-bearing reels. The player may select a number of pay lines to play, an amount to wager, and start game play via the touch screen 20 or the push-buttons 14, causing the CPU 18 to set the reels in motion, randomly select a game outcome, and then stop the reels to display symbols corresponding to the pre-selected game outcome. In one embodiment, one of the basic game outcomes triggers a free spin bonus feature.

A system memory 22 stores control software, operational instructions and data associated with the gaming machine 10. In one embodiment, the system memory 22 comprises a separate read-only memory (ROM) and battery-backed random-access memory (RAM). However, it will be appreciated that the system memory 22 may be implemented on any of several alternative types of memory structures or may be implemented on a single memory structure. A payoff mechanism 24 is operable in response to instructions from the CPU 18 to award a payoff to the player in response to certain winning outcomes that might occur in the basic game or the free spin feature. The payoff may be provided in the form of coins, bills, tickets, coupons, cards, etc. The payoff amounts are determined by one or more pay tables stored in the system memory 22.

Figure 3:
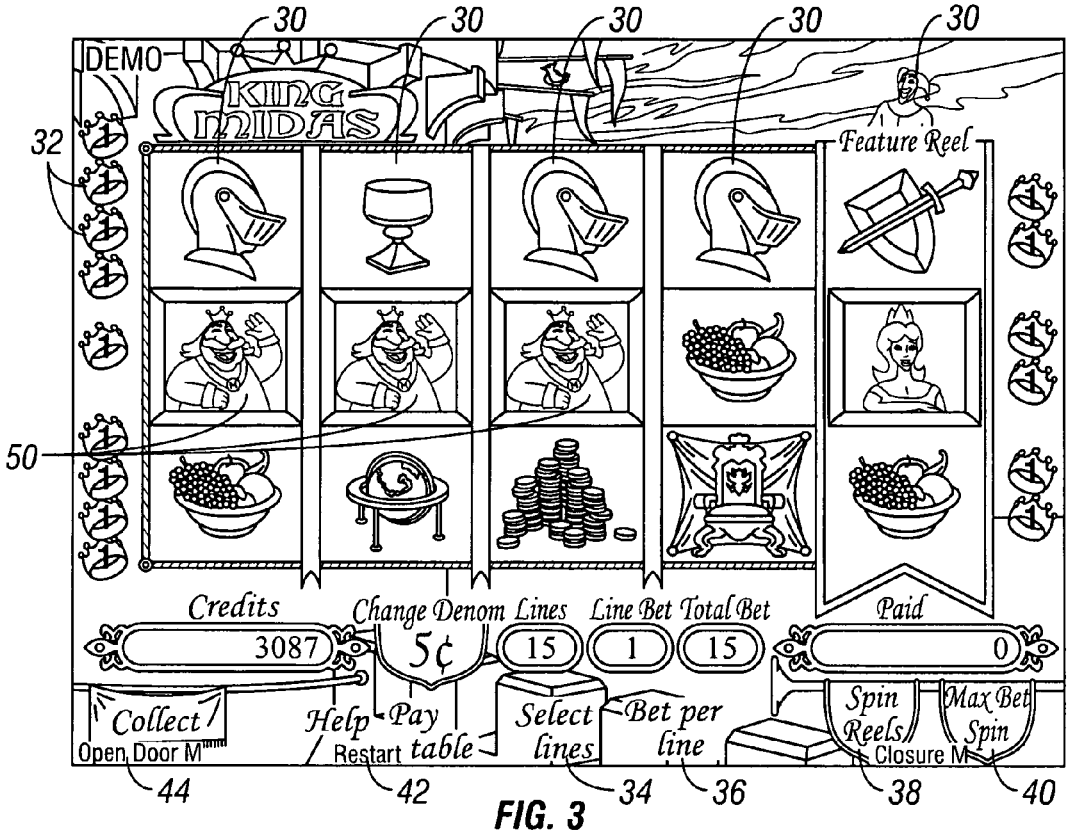
FIG. 3 is a display image associated with a basic slot game and showing a symbol combination for triggering a free spin bonus feature.

Referring to FIG. 3, the basic game is implemented on the display 12 on five video simulated spinning reels 30 with a number of pay lines 32. The number of reels and pay lines may be varied to be more or less than the number illustrated. Each of the pay lines 32 extends through one symbol on each of the reels 30. Generally, game play is initiated by inserting money or playing a number of credits, causing the CPU to activate a number of pay lines corresponding to the amount of money or number of credits played. In one embodiment, the player selects the number of pay lines to play by pressing a "Select Lines" key 34. The player then chooses the number of coins or credits to bet on the selected pay lines by pressing the "Bet Per Line" key 36.

After activation of the pay lines, the reels 30 may be set in motion by touching the "Spin Reels" key 38 or, if the player wishes to bet the maximum amount per line, by using the "Max Bet Spin" key 40. Alternatively, other mechanisms such as, for example, a lever or push button may be used to set the reels in motion. The CPU uses a random number generator to select a game outcome (e.g., "basic" game outcome) corresponding to a particular set of reel "stop positions." The CPU then causes each of the video reels 30 to stop at the appropriate stop position. Video symbols are displayed on the reels 30 to graphically illustrate the reel stop positions and indicate whether the stop positions of the reels represent a winning game outcome.

Winning basic game outcomes (e.g., symbol combinations resulting in payment of coins or credits) are identifiable to the player by a pay table. In one embodiment, the pay table is affixed to the machine 10 and/or displayed by the video display 12 in response to a command by the player (e.g., by pressing the "Pay Table" button 42). A winning basic game outcome generally occurs when the symbols form a line pay or a scatter pay. A line pay occurs when symbols along an active pay line correspond to one of the winning line pay combinations on the pay table. For example, a winning line pay combination could be three or more matching symbols along an active pay line, where the award is greater as the number of matching symbols along the active pay line increases. A scatter pay occurs when symbols anywhere on the display, regardless of whether the symbols are along an active pay line, correspond to one of the winning scatter pay combinations on the pay table. If the displayed symbols stop in a winning combination, the game credits the player an amount corresponding to the award in the pay table for that combination multiplied by the line bet (in the case of a line pay) or the total bet (in case of a scatter pay). The player may collect the amount of accumulated credits by pressing the "Collect" button 44. In one implementation, the winning combinations start from the leftmost reel (left to right) and span adjacent reels. In an alternative implementation, the winning combinations start from either the leftmost reel (left to right) or the rightmost reel (right to left) and span adjacent reels.

Included among the plurality of basic game outcomes is a start-feature outcome for triggering play of a free spin bonus feature. A start-feature outcome may be defined in any number of ways. For example, a start-feature outcome occurs when a special start-feature symbol or a special combination of symbols appears on one or more of the reels 30. The start-feature outcome may require the combination of symbols to appear along an active pay line (i.e. a line trigger), or may alternatively require that the combination of symbols appear anywhere on the display regardless of whether the symbols are along an active pay line (i.e. a scatter trigger). The appearance of the appropriate start-feature outcome causes the CPU to shift operation from the basic game to the free spin bonus feature of the present invention.

In the embodiment illustrated in FIG. 3, the appearance of three scattered KING MIDAS symbols 50 anywhere on the display triggers a free spin bonus feature called a Midas Touch Bonus. The KING MIDAS symbols 50 are highlighted using, for example, a flashing border.

Figure 4:
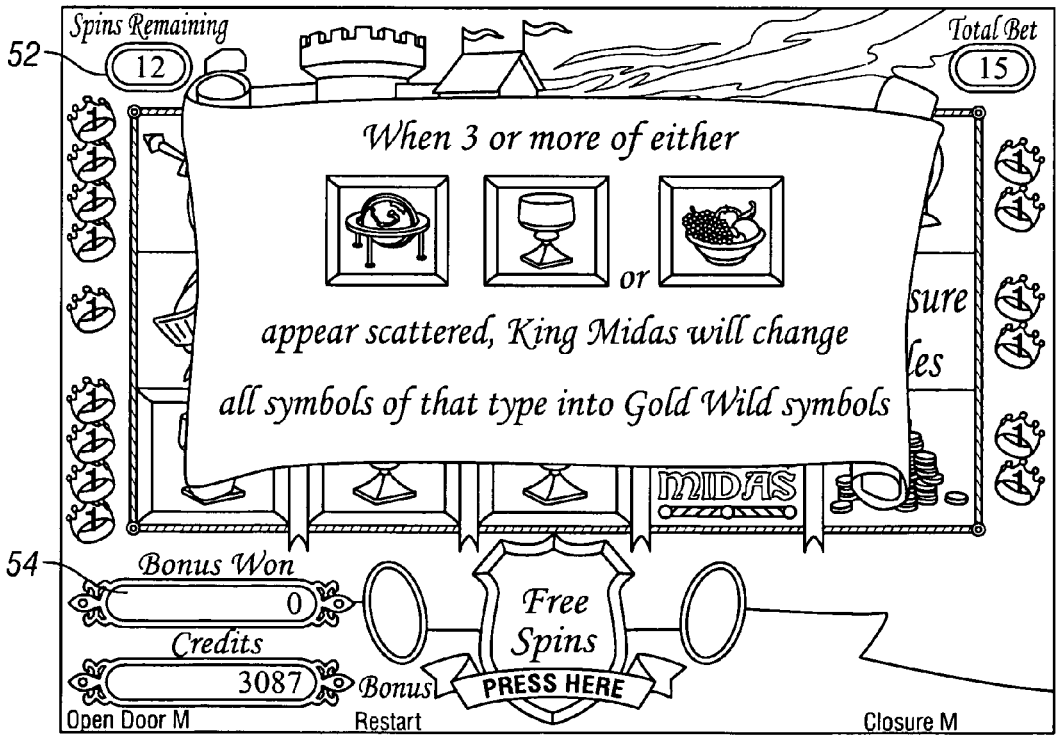
FIGS. 4 through 10 are display images associated with the free spin feature.

Referring to FIG. 4, the Midas Touch Bonus provides the player with a random or predetermined number of free spins of the reels 30. A "spins remaining" meter 52 counts down the number of free spins remaining in the free spin feature. A "bonus won" meter 54 indicates the number of credits won during the free spin feature. As in the basic game described above, the player is awarded for any winning line pay or scatter pay combinations resulting from each free spin. A pay table indicates the winning combinations and associated awards applicable to the free spin feature. This pay table may be the same as, or different from, the pay table applicable to the basic game. Also, the reels 30, symbols thereon, and/or arrangement of the symbols thereon may be the same as, or different from, the reels, symbols, and/or arrangement applicable to the basic game. At the beginning of the Midas Touch Bonus, the player is notified that when three or more of either a GLOBE symbol, a GLOBLET symbol, or a FRUIT BOWL symbol appear scattered, King Midas will change all symbols of that type into wild symbols for the current spin and all remaining free spins.

Figure 5:
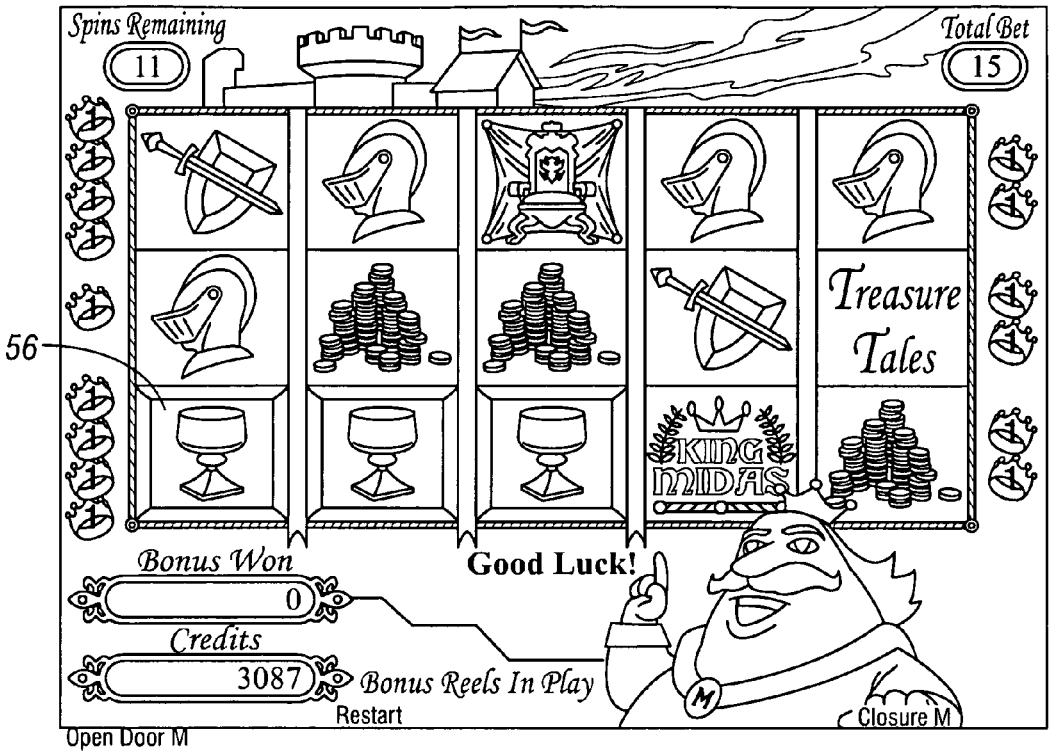
Figure 6:
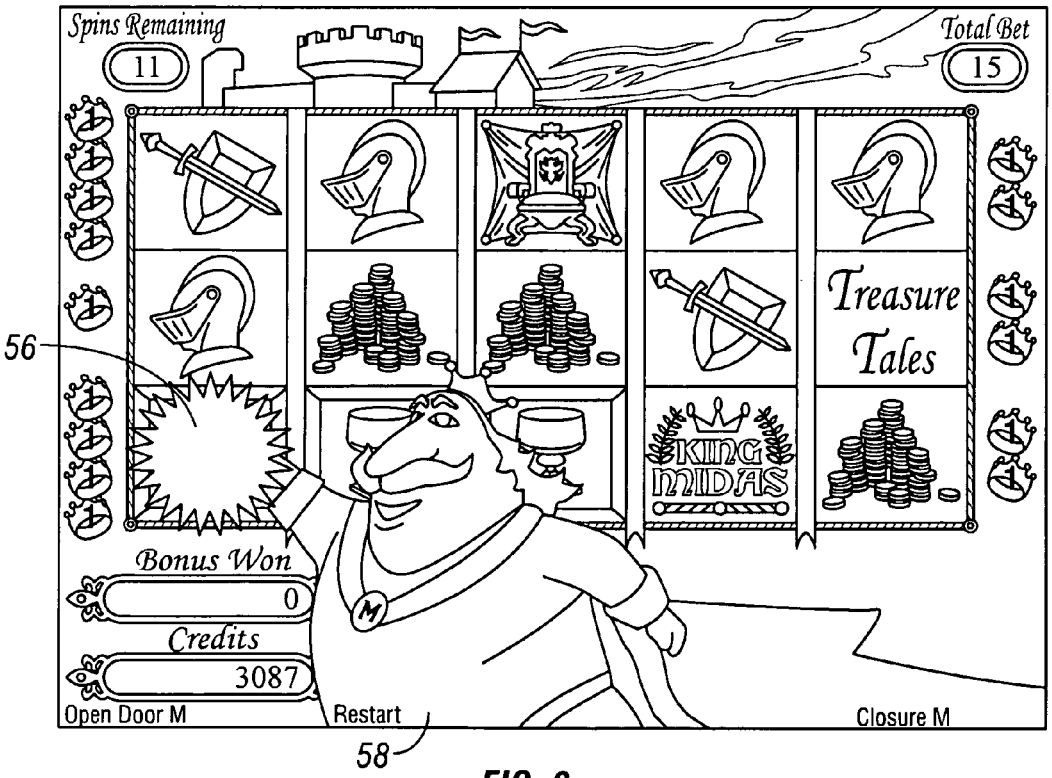
Figure 7:
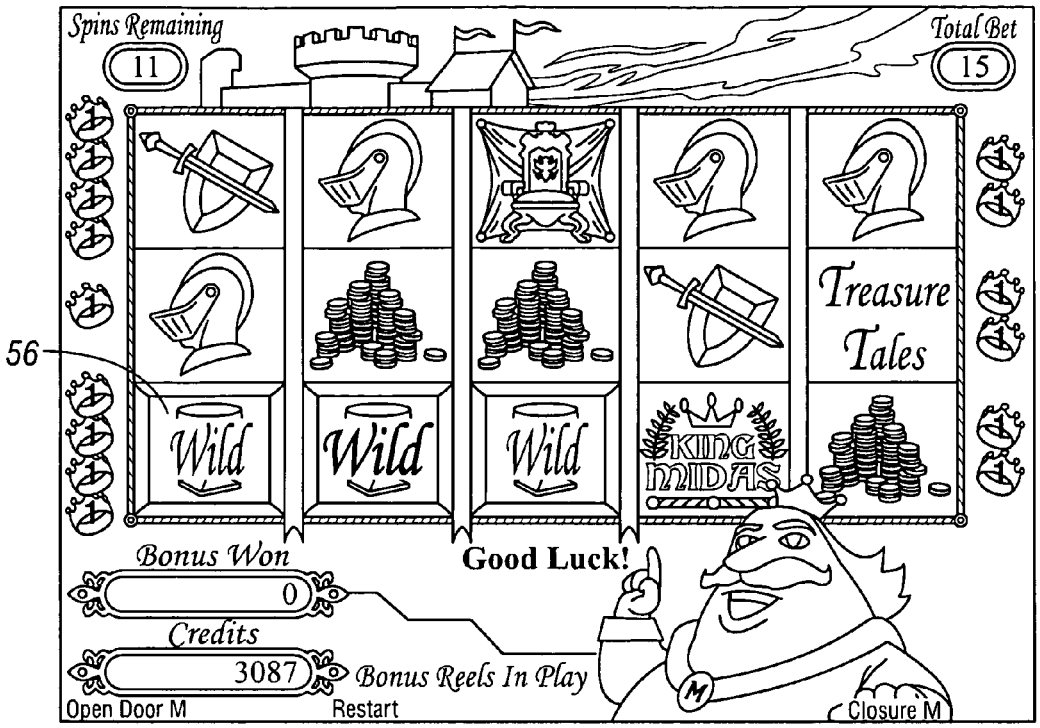
Figure 8:
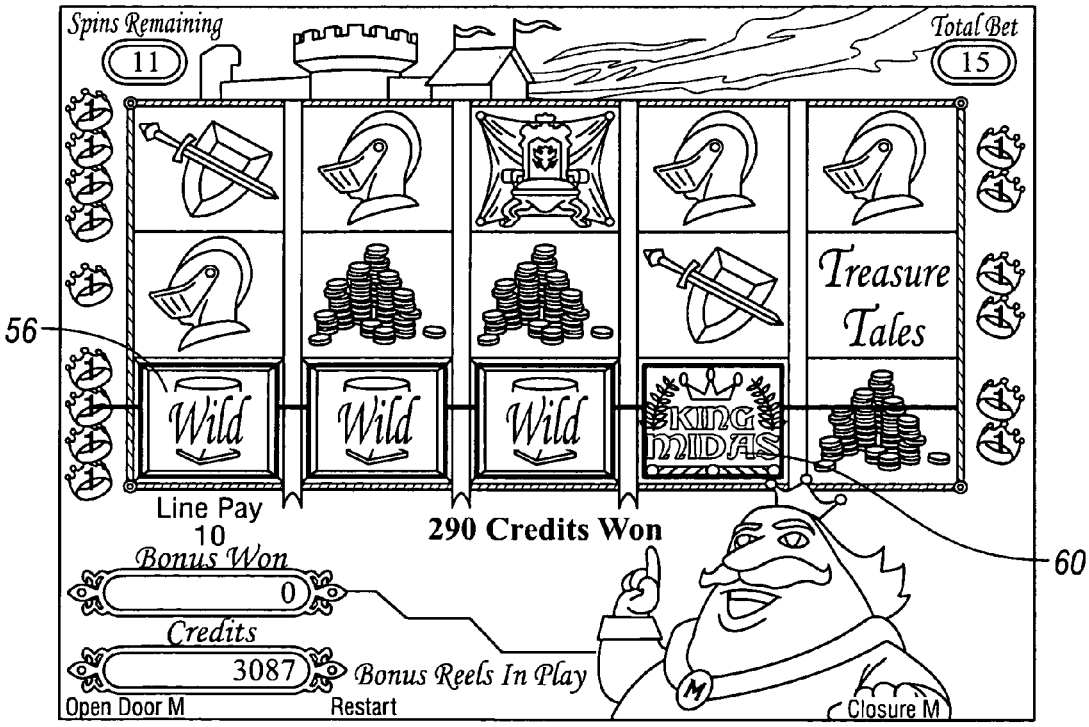
Figure 9:
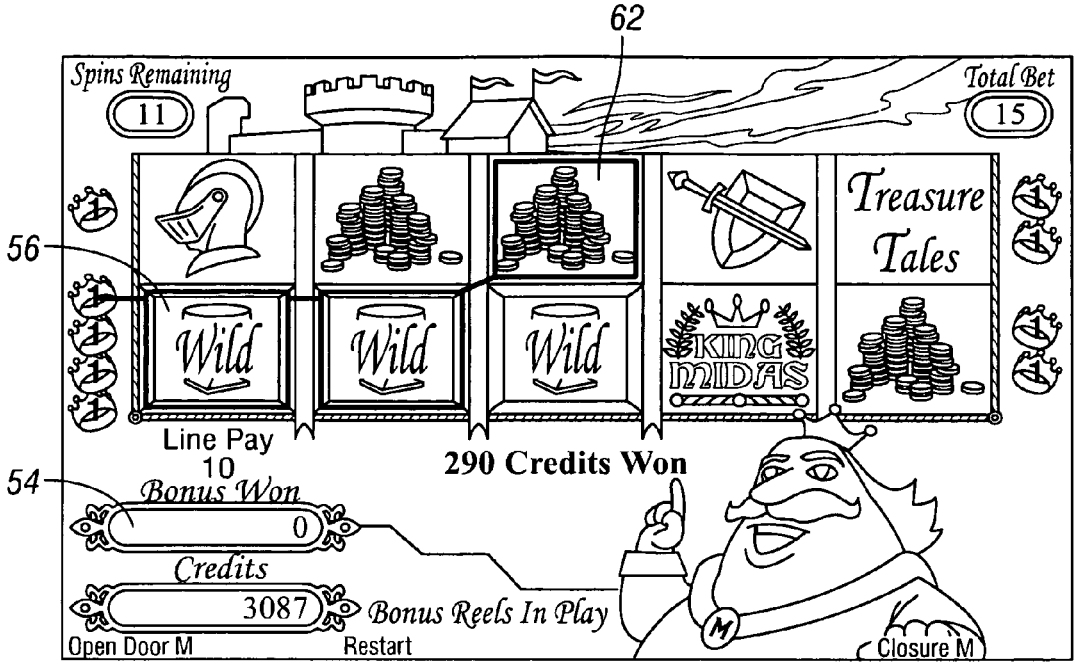
Figure 10:
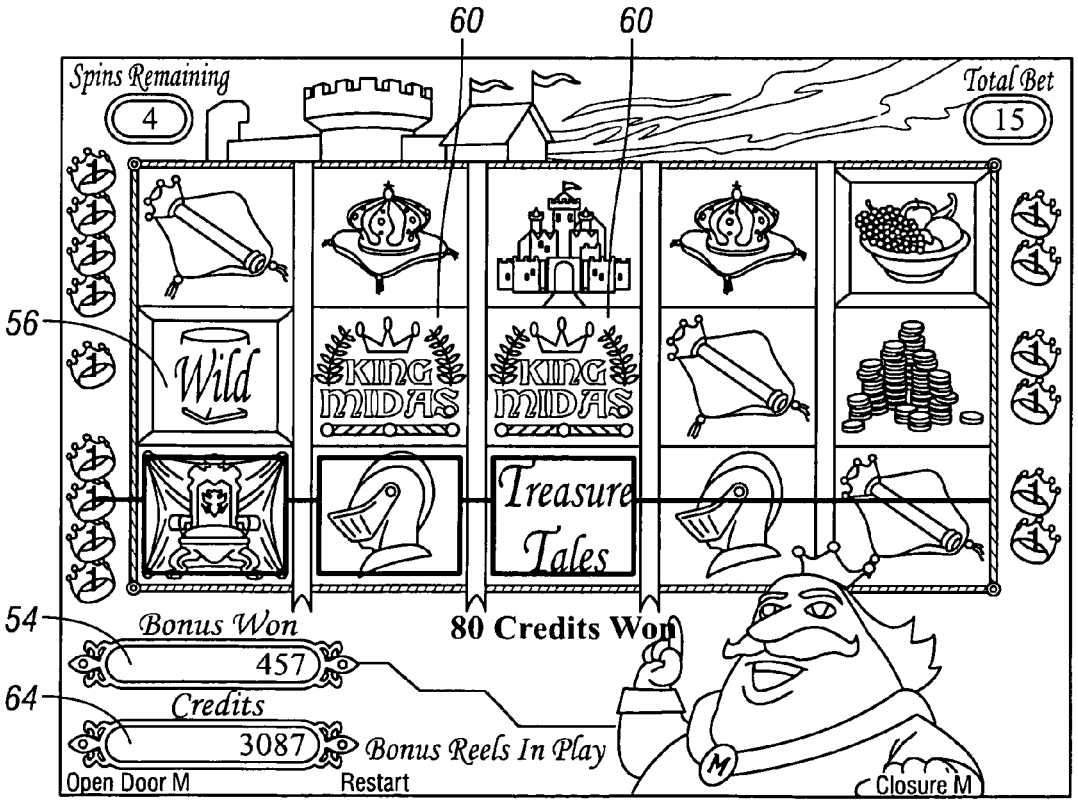

In the illustrated example, FIG. 5 depicts three scattered GOBLET symbols 56. FIG. 6 depicts King Midas 58 touching one of the GOBLET symbols 56 to transform the GOBLET symbols 56 into wild GOBLET symbols 56 with the term "wild" superimposed thereon. FIG. 7 depicts the wild GOBLET symbols 56 resulting from the transformation. Referring to FIGS. 8 and 9, with the GOBLET symbols 56 now evaluated as wilds, the current spin yields a first winning line pay combination of four KING MIDAS symbols (including three wild GOBLET symbols 56 and one KING MIDAS symbols 60) and a second winning line pay combination of three COIN symbols (including two wild GOBLET symbols 56 and one COIN symbol 62). The total credits won for these winning combinations is added to the "bonus won" meter 54. The GOBLET symbol 56 remains wild for subsequent spins in the King Midas Bonus. For example, referring to FIG. 10, a later free spin yields a winning line pay combination of three KING MIDAS symbols (including one wild GOBLET symbol 56 and two KING MIDAS symbols 60) worth 80 bonus credits. In the illustrated embodiment, the wild function of the GOBLET symbols 56 persists for the remainder of the free spin feature. If three or more of either the GLOBE symbol or the FRUIT BOWL symbol appear scattered during these remaining spins, such symbol will also be evaluated as a wild such that multiple symbols may be concurrently and persistently evaluated as wilds. At the conclusion of the King Midas Bonus, the total number of credits in the "bonus won" meter 54 is added to the basic credit meter 64.

A number of alternative embodiments are possible. A symbol may be transformed to have a special function other than being a standard wild. In one embodiment, the symbol may be transformed to operate as a wild for only a limited number of the other symbols. In another embodiment, the symbol may be transformed to operate as an expanding wild such that, when the symbol appears on the reels, the symbol itself is wild and expands to designate the entire reel containing the symbol, the entire row containing the symbol, the adjacent symbols surrounding the symbol, or some other symbol group as wild. In another embodiment, the symbol may be transformed from a line pay symbol to a scatter pay symbol such that a winning combination of the transformed symbol will result an award regardless of whether or not the combination appears along an active pay line. In another embodiment, the symbol may be transformed to operate as a multiple or reproducing symbol such that the appearance of a single one of that symbol actually represents a plurality of that symbol when evaluating the quantity of that symbol in a combination. A double symbol, for example, would represent two of that symbol. In a related embodiment, the symbol may be transformed to reduce the number of that symbol required to yield a winning combination. In another embodiment, the symbol may be transformed to operate as a morphing symbol such that the appearance of that symbol causes the symbol to randomly change to one of the other symbols. The random change may occur automatically or in response to player input. The player may be given an option to change a symbol up to a predetermined number of times. For example, if changing the symbol yields a winning combination having a small award, the player may either accept that award, or reject the award and change the symbol again in an effort to achieve a higher award. In another embodiment, the symbol may be transformed to operate as a payout multiplier such that if the symbol is part of a winning combination, the standard payout for that winning combination is multiplied by a random or predetermined multiplier.

In another embodiment, the special function may persist for a random or predetermined number of successive spins but not necessarily for all the remaining free spins. In another embodiment, whether or not the special function persists for additional spins may depend upon whether the special function yields a winning combination. If the special function does not yield a winning combination, then the special function ceases to exist; if the special function yields a winning combination, then the special function exists for one or more additional spins. In another embodiment, if a first symbol (e.g., the GOBLET symbol 56) is transformed into a wild but then a second symbol (e.g., the GLOBE symbol) is later transformed into a wild, then the first symbol may be transformed back into a non-wild when the second symbol is transformed into a wild such that only one symbol is wild at any given time. In another alternative embodiment, a first symbol may be transformed to have a first special function (e.g., wild), while a second symbol may be transformed to have a second special function (e.g., scatter).

The transformation of a symbol to have a special function preferably occurs in response to a random event. In the illustrated embodiment, the random event is three or more of that symbol appearing scattered on the display. In an alternative embodiment, the random event is less than three (e.g., only one) of that symbol appearing scattered on the display. In another embodiment, the random event for transforming a symbol to have a special function is the appearance of another symbol or symbol combination on the display. In another embodiment, the random event is independent of the symbols on the reels. Such a non-reel random event may be depicted on a secondary display or may be more of a mystery. King Midas 58 could, for example, decide to touch or otherwise designate a symbol to have a special function at a random time during the free spin feature.

While the present invention has been described with reference to one or more particular embodiments, those skilled in the art will recognize that many changes may be made thereto without departing from the spirit and scope of the present invention. For example, the free spin feature may be played on a symbol array in which each symbol is generated independently of the other symbols. Also, the transformation of a symbol to have a special function may occur during the basic slot game, instead of or in addition to the free spin feature, and the special function for that symbol may persist for a random or predetermined number of successive spins of the reels during the basic game. The various alternative embodiments discussed above may apply to this basic slot game embodiment as well. Each of these embodiments and obvious variations thereof is contemplated as falling within the spirit and scope of the claimed invention, which is set forth in the following claims.

What is claimed is:

1. A method of conducting a wagering game on a gaming machine, comprising:

receiving a wager from a player to initiate a play of the wagering game;

using a wager detector of a gaming machine to signal a processor that the wager has been received from the player;

using the processor to execute a game program that causes a display of the gaming machine to display successive arrays of symbols during the play of the wagering game, each array of the successive arrays being comprised of a plurality of rows and columns and being generated by a plurality of symbol-bearing reels that are rotated and stopped to place symbols on the reels in visual association with a display area;

respinning all the reels of the plurality of symbol-beating reels to generate a respective array of a subsequent plurality of the successive arrays;

in response to multiple predetermined symbols of one type being randomly displayed, altering a function of at least one symbol of the symbols on the reels and maintaining the function for the at least one symbol for one or more of the subsequent plurality of the successive arrays resulting from the respinning, the function for the at least one symbol being retained for one or more of the subsequent plurality of the successive arrays resulting from successive respinning of the reels; and awarding payouts for the successive arrays according to a pay table.

2. The method of claim 1, wherein the symbols of each away are randomly selected.

3. The method of claim 1, wherein the function is selected from a group consisting of a wild function, scatter pay function, a morphing function, and a reproducing function.

4. The method of claim 1, wherein the altering step includes maintaining the function for that symbol for a random number of the successive arrays.

5. The method of claim 1, wherein the altering step includes maintaining the function for that symbol for a predetermined number of the successive arrays.

6. The method of claim 1, wherein the randomly displayed multiple predetermined symbols include an appearance of a plurality of the at least one symbol in one of the successive arrays.

7. The method of claim 1, wherein the randomly displayed multiple predetermined symbols include an appearance of another symbol or symbol combination, other than the at least one symbol, in one of the successive arrays.

8. The method of claim 1, wherein the randomly displayed multiple predetermined symbols are independent of the symbols in the successive arrays.

9. The method of claim 1, wherein the displaying step is triggered by a special outcome in a basic game.

10. A method of conducting a wagering game on a gaming machine, comprising:

receiving a wager from a player to initiate a play of the wagering game;

using a wager detector of a gaming machine to signal a processor that the wager has been received from the player;

using the processor to execute a game program that causes a display of the gaming machine to display successive free spins of a plurality of symbol-bearing reels during the play of the wagering game, wherein in each free spin the plurality of reels are rotated and stopped to place symbols on the reels in visual association with a display area;

respinning all the reels of the plurality of symbol-beating reels to place the symbols on the reels in visual association with the display area for each of the subsequent plurality of the successive free spins;

in response to multiple predetermined symbols of one type being randomly displayed, altering a function of at least one symbol of the symbols on the reels and maintaining the function for the at least one symbol for one or more of the subsequent plurality of the successive free spins resulting from the respinning, the function for the at least one symbol being retained for one or more of the subsequent plurality of the successive free spins resulting from successive respinning of the reels; and awarding payouts for the successive free spins according to a pay table.

11. The method of claim 10, wherein the displaying step is triggered by a special outcome in a basic game.

12. The method of claim 10, wherein the function is selected from a group consisting of a wild function, scatter pay function, a morphing function, and a reproducing function.

13. The method of claim 10, wherein the altering step includes maintaining the function for that symbol for a random number of the successive free spins.

14. The method of claim 10, wherein the altering step includes maintaining the function for that symbol for a predetermined number of the successive free spins.

15. The method of claim 10, wherein the randomly displayed multiple predetermined symbols include an appearance of a plurality of the at least one symbol in one of the successive free spins.

16. A gaming system comprising:

a value input device for receiving a wager from a player to initiate a play of the wagering game;

a display for displaying successive arrays of symbols during the play of the wagering game, each array of the successive arrays being comprised of a plurality of rows and columns and being generated by a plurality of symbol-bearing reels that are rotated and stopped to place symbols on the reels in visual association with an area of the display;

a processor, responsive to multiple predetermined symbols of one type being randomly displayed, operative to alter a function of at least one symbol of the symbols on the reels;

respin all the reels of the plurality of symbol-bearing reels to generate a respective array of a subsequent plurality of the successive arrays;

maintain the function for the at least one symbol for one or more of the subsequent plurality of the successive arrays resulting from the respinning, the function for the at least one symbol being retained for one or more of the subsequent plurality of the successive arrays resulting from successive respinning of the reels; and an award apparatus for awarding payouts for the successive arrays according to a pay table.

17. The system of claim 16, wherein the symbols of each array of the successive arrays are randomly selected.

18. The system of claim 16, wherein the function is selected from a group consisting of a wild function, scatter pay function, a morphing function, and a reproducing function.

19. The system of claim 16, wherein the processor is operative to maintain the function for the symbol for a random number of the successive arrays.

20. The system of claim 16, wherein the processor is operative to maintain the function for the symbol for a predetermined number of the successive arrays.

21. The system of claim 16, wherein the randomly displayed multiple predetermined symbols include an appearance of a plurality of the at least one symbol in one of the successive arrays.

22. The system of claim 16, wherein the randomly displayed multiple predetermined symbols include an appearance of another symbol or symbol combination, other than the at least one symbol, in one of the successive arrays.

23. The system of claim 16, wherein the randomly displayed multiple predetermined symbols are independent of the symbols in the successive arrays.

24. The system of claim 16, wherein the display is operative to display the successive arrays of symbols in response to a special outcome in a basic game.

* * * * *